United States Patent [19]

Landwehrkamp et al.

[11] Patent Number: 4,505,102

[45] Date of Patent: Mar. 19, 1985

[54] PROTECTOR DEVICE FOR AN OPEN-END SPINNING APPARATUS

[75] Inventors: Hans Landwehrkamp, Lenting; Gottfried Schneider; Johann Pohn, both of Ingolstadt, all of Fed. Rep. of Germany

[73] Assignee: Schubert & Salzer, Ingolstadt, Fed. Rep. of Germany

[21] Appl. No.: 523,717

[22] Filed: Aug. 16, 1983

[30] Foreign Application Priority Data

Aug. 18, 1982 [DE] Fed. Rep. of Germany ..... 3230620

[51] Int. Cl.[3] ..... D01H 7/895; D01H 7/888

[52] U.S. Cl. ..... 57/408; 57/301; 57/413

[58] Field of Search ..... 57/301, 408, 409, 413

[56] References Cited

U.S. PATENT DOCUMENTS 4,024,699 5/1977 Goldammer et al. ..... 57/408 X
4,201,037 5/1980 Artzt et al. ..... 57/301
4,387,558 6/1983 Rehn et al. ..... 57/408
4,435,954 3/1984 Seiki et al. ..... 57/408

*Primary Examiner*—Donald Watkins
*Attorney, Agent, or Firm*—Dority & Manning

[57] ABSTRACT

The housing (1) of a opening device for an open-end spinning apparatus is lined by a thin-walled insert (3) which exhibits a perforation for the discharge of material (dirt, fibers) from the interior space of the housing (1). For the protection of the edge (310) bounding this perforation downstream relative to the fiber flow, an edge protector (4) is provided which is slidable onto the edge (310) engaging over the latter. For sliding the edge protector (4) onto the edge (310) to be protected, or for stripping it therefrom, a combined insertion and ejection tool (5) is provided which is introducible into the insert (3) and movable with a contact surface (51) along the peripheral wall (33) of the insert (3). The combined insertion and ejection tool (5) has a receiving throat (6) for the temporary reception of the edge protector (4) with a step (60) overhanging the contact surface (51) and in turn exhibiting a stripping edge (67).

5 Claims, 8 Drawing Figures

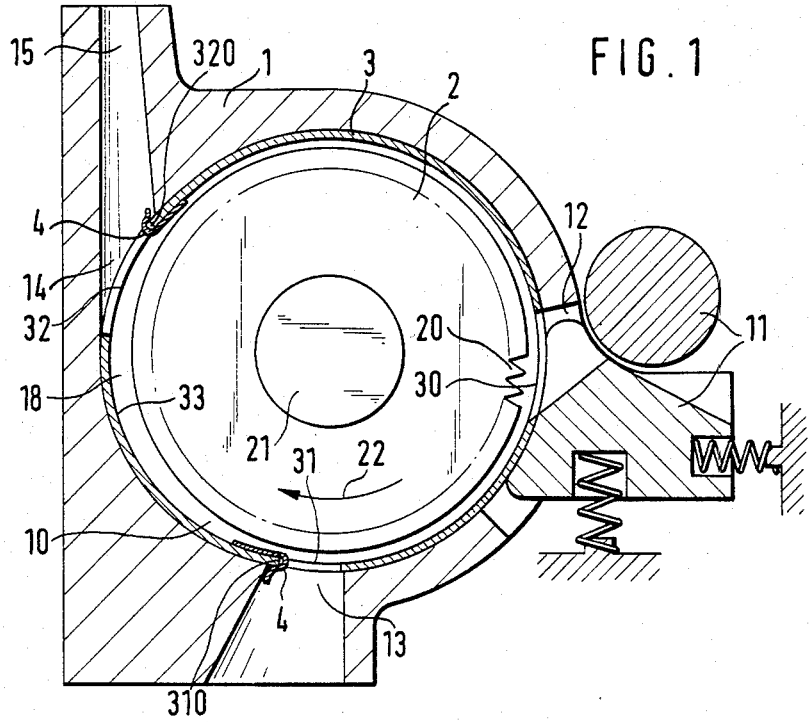
FIG. 1
FIG. 2
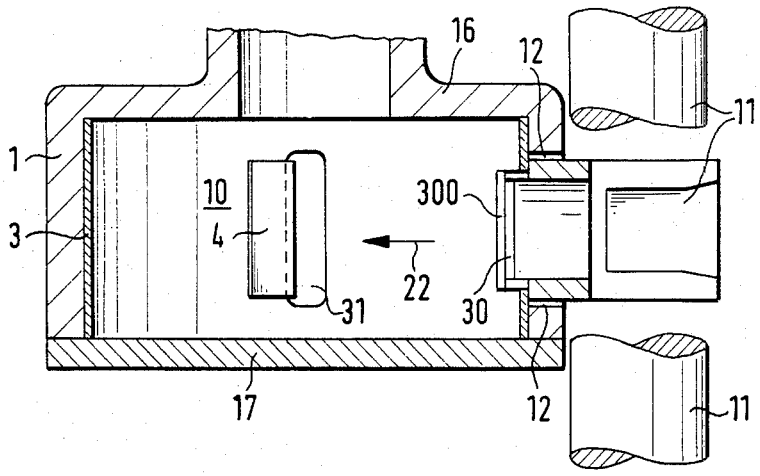

PROTECTOR DEVICE FOR AN OPEN-END SPINNING APPARATUS

BACKGROUND OF THE INVENTION

The present invention relates to a protector device for an open-end spinning apparatus including a housing. The end walls of the housing are formed by a fixed end wall to support an opening roller and by an openable cover. In the interior space of the housing, an insert receiving the opening or loosening roller is arranged, which has openings that correspond to housing orifices. The orifices connect the interior space to other parts of the spinning apparatus, while at least in the case of an opening intended for discharging material out of the interior space, the edge which bounds the opening downstream relative to the fiber flow partly masks the housing orifice associated with it.

It is known to line the housing of a loosening roller with a one-piece or multiple-piece insert for protection against wear (German Auslegeschriften Nos. 2,423,241 and 2,448,585). In the region of housing orifices which connect the interior space of the housing to parts of the spinning apparatus arranged outside it, the insert has perforations in the form of material interruptions (in the case of multiple-piece inserts) or ports (in the case of one-piece inserts). In order to protect the edges of the housing from wear, and to improve the discharge of fibers or dirt from the loosening roller, the perforations in this case are kept smaller than the associated housing orifices (German Auslegeschrift No. 2,448,585). However, because the inserts themselves are extremely thin-walled, they are subject to heavy wear, so that various attempts have been made to permit the insert to be exchanged rapidly (German Offenlegungschriften Nos. 2,819,060 and 2,911,158). However, such inserts are still relatively onerous to produce and to install. If the inserts are not exchanged punctually, then undefined conditions arise at the perforations serving to discharge fibers and/or dirt, which prejudice the spinning results.

It is therefore the object of the present invention to avoid the reported disadvantages. The aim to be achieved by means of the present invention is to produce an apparatus which creates constant loosening conditions and fiber feed conditions more economically than heretofore and is also simple in construction and in handling.

SUMMARY OF THE INVENTION

This aim is achieved according to the invention by an edge protector which is slidable onto the edge engaging over the latter.

Such an edge protector has very little bulk and therefore causes no appreciable impairment of the spinning result. Moreover, this edge protector is extremely cheap in its use of material, in production and also in installation (assembly and disassembly). Such an edge protector may therefore be used either after a certain service life of the insert, or else from the outset.

The edge protector may exhibit different shapes, so that it can form different edge shapes. By this means, particularly, the dirt discharge can be adapted in simple manner to the material processed.

Because the edge protector is so cheap, it can also be exchanged more frequently than the actual inserts. With a view to optimum spinning conditions, such an edge protector may therefore be extremely thin, so that according to a further feature of the invention the sheet-metal thickness of the material processed for the edge protector is smaller than the sheet-metal thickness of the thin-walled insert.

In order to slide the edge protector onto the edge to be protected, it is sufficient in the case of an appropriate relative configuration of the two members to round the free end of the one or other member or else both members on their inside. However, a better fit is obtained with a view to a higher obtainable clamping pressure if, according to a further feature of the invention, the member of the edge protector remote from the interior space of the housing exhibits a terminal section which stands away from the member facing the interior space.

The sliding of the edge protector onto the edge to be protected is advantageously additionally facilitated in that the member of the edge protector facing the interior space exhibits, considered in the peripheral direction of the interior space, a greater length than the member remote from the interior space. Further assistance in sliding the edge protector onto the edge to be protected is achieved according to the invention in that at least the preferably shorter member of the edge protector remote from the interior space exhibits blunted corners, which can be achieved by rounding or bevelling.

The fiber material transported and the dirt constituents discharged subject the edges to be protected to wear, not only in the peripheral direction but also in the radial direction, which has particularly diadvantageous effects in the region of a bulge. In order to renew the peripheral surfaces in the edge region, or to prevent any wear here, it is provided according to a further feature of the invention, that the interval between the insert and the card clothing points of the loosening roller is determinable by the thickness of the member of the edge protector located in the interior space of the housing.

The edge protector is extremely small, because its needs only to mask the edge of the insert which is subjected to increased wear. Because, with the housing installed, the edges are difficult to see during the insertion of the edge protector, another aim is to produce an apparatus which permits the assembly and/or disassembly of the edge protector in the simplest manner. For this purpose according to the invention an insertion tool introducible into the insert and movable with a contact surface along its peripheral wall is provided, with a receiving throat for the temporary reception of the edge protector, while the receiving throat, which faces the edge to be protected in the peripheral direction of the peripheral wall, is bounded by a stop overhanging the contact surface of the insertion tool and exhibits a length corresponding substantially to the length of the edge protector. By a substantially circular movement of the insertion tool along the peripheral wall of the insert, the receiving throat with the edge protector previously placed therein reaches the edge to be protected, while the edge protector is slid exactly onto the edge to be protected, by the stop of the receiving throat, coordinated with the length of the edge protector, achieves a definite position of the edge protector relative to the insertion tool, which substantially simplifies the introduction of the insertion tool into the housing.

The contact surface conveniently engages over the receiving throat at both its ends, while the bracing surface of the receiving throat opposite the insert is arranged set back relative to the contact surface substantially by the material thickness of the edge protector. In this manner, a correct feeding of the edge protector to the edge to be protected is ensured also radially—relative to the center of the interior space of the housing.

For temporary retention of the edge protector during insertion, the receiving throat is conveniently bounded on its side facing the insert in the housing by a resilient stop, so that the edge protector is retained elastically between the inelastic insertion tool and the resilient stop. However, according to a preferred embodiment of the object of the invention, the receiving throat is bounded on its side remote from the insert in the housing by a permanent magnet and on its side facing the insert by a stop surface arranged substantially at right angles to the peripheral wall. Such a construction is more robust than the first embodiment. Futhermore, it permits retention of the edge protector in a simpler manner than an elastic stop. To facilitate the manual insertion of the edge protector into the receiving throat, it is conveniently provided that the permanent magnet is subdivided into two partial magnets which are arranged at a mutual interval at the two ends of the receiving throat.

In order to permit the edge protector to be fed to the edge to be protected without difficulty, having regard to the depth of the interior space of the housing, when the insert exhibits a perforation enclosed all around, the edge of which is required to be portected by the edge protector, the insertion tool conveniently exhibits between its receiving throat and its end facing the fixed end wall and perforation of the housing, a bracing length which corresponds substantially to the interval between end wall. In this manner, when the insertion tool is brought into contact with the end wall of the housing, the receiving throat with the edge protector is always located in the region of the edge to be protected, so that the placing of the edge protector is ensured extremely simply.

It is entirely possible also to exchange the edge protector when it has become correspondingly worn after a long service life. In this case the ejection of the edge protector may be effected manually. Conveniently however, an ejection tool introducible into the insert and movable with a contact surface along its peripheral wall, having a sharp stripping edge overhanging the contact surface of the ejection tool and remote from the edge to be protected, is provided for this purpose. Due to the movement of the ejection tool along the peripheral wall of the insert, the stripping edge comes into contact with the edge protector and strips the latter from the edge of the insert to be protected. So that the stripped edge protector does not drop off, according to a preferred embodiment of the object of the invention, the ejection tool carries a permanent magnet in front of the stripping edge in the stripping direction.

Separate tools may be adopted for the insertion of the edge protector and for its ejection. Preferably, however, a combined insertion and ejection tool which has, for example, a receiving throat at the end of its contact surface in the insertion direction and a sharp edge at the end of this contact surface in the ejection direction is provided for these purposes. The combined insertion and ejection tool is conveniently introducible rotated through 180° to the insert, while the stop is provided with a sharp stripping edge overhanging the contact surface. In this manner, the stop can serve as a receiving throat in the one case, namely for the insertion of the edge protector, and as an ejection edge in the other case, namely for the ejection of the edge protector. In the case of an opening device, wherein such a perforation is arranged with an edge to be protected centrally at an interval between the two end walls of the housing, it is advantageously provided that the combined insertion and ejection tool exhibits a bracing length corresponding to the interval between perforation and end wall on both sides of the receiving throat. In this manner, when the insertion and ejection tool is in contact with the end wall, it is ensured that both the receiving throat during insertion of the edge protector, and the stripping edge during ejection of the edge protector, enter the region of the edge to be protected and thus ensure the insertion or ejection respectively of the edge protector.

In order that a precise radial feeding of the edge protector to the edge to be protected is ensured, it is preferably provided that the contact surface of the insertion tool, of the ejection tool, or of the combined insertion and ejection tool, which can be brought into contact with the peripheral wall of the insert, is substantially adapted to the curvature of the peripheral wall. In order to exclude with certainty any catching on the edge to be protected during the movement of this element in the peripheral direction in the case of its inaccurate introduction into the interior space of the housing or of tolerances, it is provided as a further development of the object of the invention that the contact surface engages over the receiving throat at both ends and merges into ramp surfaces towards the receiving throat.

According to a preferred embodiment of the object of the invention a handle is provided which can be attached selectively to the one or other end of the combined insertion and ejection tool. In this case, a screwthreaded connection is conveniently provided between the handle and the combined insertion and ejection tool, while the direction of the screwthread pitch coincides with the insertion direction of the edge protector.

The object of the invention makes it possible to prolong substantially the useful life of linings or inserts, customary per se, for opening roller housings. Despite the unavoidable wearing of the edges of such thin-walled inserts, they can be produced from lower-grade material than previously. Each worn edge is restored within a few seconds, by a placeable and exchangeable edge protector, to such a state as permits further use of the insert and effects improvement of the yarn qualities. The insertion of a new edge protector, or its exchange, can be accomplished manually or by means of very simple apparatus, which are so handy that the person responsible for the insertion or exchange of the edge protector can immediately carry them with him in the pocket of his overalls.

BRIEF DESCRIPTION OF THE DRAWINGS

Further particulars of the invention are more fully explained below with reference to the drawings, wherein:

FIG. 1 shows in cross-section an opening device of an open-end spinning apparatus with the edge protector according to the invention.

FIG. 2 shows the apparatus shown in FIG. 1 in longitudinal section.

DESCRIPTION OF THE PREFERRED EMBODIMENT

Figure 3:
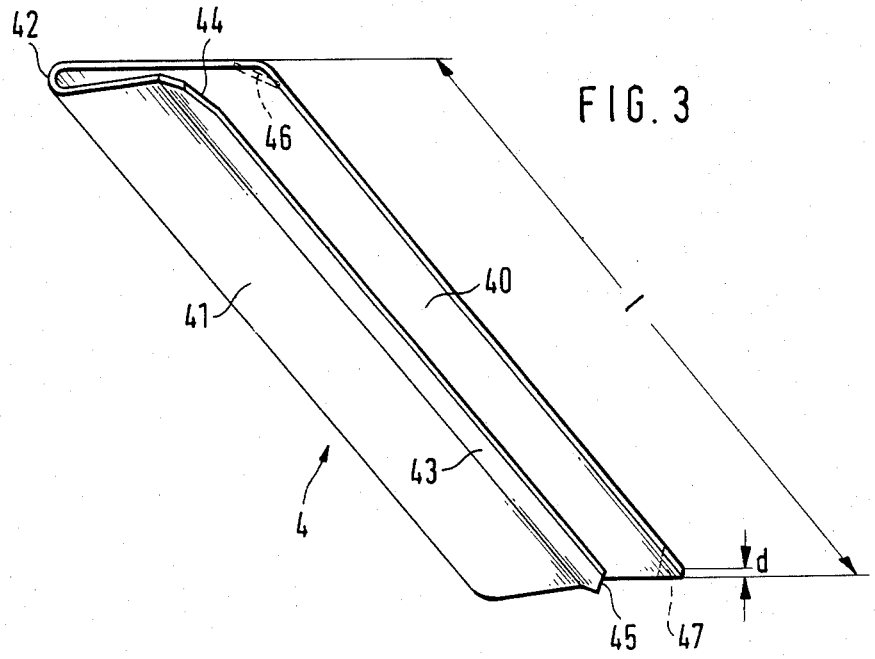
FIG. 3 shows the edge protector according to the invention in a perspective view.

FIG. 1 shows a housing of the opening device, in the interior space 10 of which, during service, an opening roller 2, shown only by indicating its card clothing points 20, is arranged. The sliver to be spun is fed to this opening roller 2 in known manner by means of a delivery device 11, for which purpose a housing orifice 12 connecting the interior space 10 to the delivery device 11 is provided in the wall surrounding the opening roller 2. In the preferred embodiment shown a further housing orifice 13, which serves for the discharge of dirt contained in the fiber material, is provided behind the housing orifice 12 in the fiber transport direction. Lastly, behind this housing orifice 13 yet a third housing orifice 14 is provided, which is adjoined by a fiber feeding canal 15 leading to an open-end spinning element not shown. In order to facilitate the separation of the fibers from the opening roller 2, an enlarged interval between the card clothing points 20 of the opening roller 2 and the wall surrounding the opening roller 2 is provided in the region in front of the housing orifice 14 compared to the remaining peripheral region of the opening roller 2, in the form of a bulge 18. The housing 1 is closed on one side by an end wall 16 (FIG. 2), through which the axis 21 of the loosening roller 2 extends. On its other side, the housing 1 is closed by a removable or otherwise openable cover 17.

The housing 1, which is generally produced as a casting in nonferrous metal, preferably by a pressure die-casting process in aluminum or zinc or an alloy with these metals as principal constituents, thus consists of a relatively soft material. Furthermore, in the case of machining of the surfaces bounding the interior space 10, there is a danger of cavities being exposed which constitute a fault in the fiber transport path and lead to breakdowns in the yarn formation.

An insert 3 is, therefore, provided in the interior space 10 of the housing 1 in order to protect the soft housing wall surfaces, to mask any possible cavities and also to improve the discharge of dirt—if present—and the fiber separation by partial covering of the housing orifice 13—if present—and the housing orifice 14, whereby a sharp edge is formed. This insert 3 consists of thin sheet metal and masks at least the peripheral wall of the interior space 10 of the housing. It may be constructed as a continuous bushing (sleeve) or also as a pot which is closed on its end face facing the end wall 16, except for an orifice for the axis 21 of the loosening roller 2. However, it is also possible to construct the insert 3 in the form of one or more finite bands. Such a band then terminates at each of the housing orifices 12 and 13, 13 and 14 or 14 and 12. In the case of a one-piece band, the interruption is provided between the housing orifices 14 and 12, in which case corresponding perforations 30, 31 and 32 are provided in the region of the housing orifices, which are bounded by a lateral edge in the peripheral direction in addition to the two edges, so that the perforations 30, 31 and 32 are enclosed on three or four sides. Independently of the special construction of the insert 3, the perforations 30, 31 and 32—which are to be understood to mean also the interstices in the region of the housing orifices 12, 13 and 14 between two such partial bands are smaller in the peripheral direction of the interior space 10 than the associated housing orifices 12, 13 and 14, so that the insert 3 overhangs the softer edges of the housing 1 counter to the fiber transport direction marked by an arrow 22, and thus prevents wear in these regions.

The insert may be produced in various materials. Since it consists of thin sheet metal, it is also subject to wear, which has a disturbing effect upon the yarn after a certain time. In the region of the perforation 30 the wear is relatively slight, because the fibers fed by the delivery device 11 cannot become caught on the edge bounding the perforation 30 in the direction of the arrow 22, but are caught and removed by the card clothing of the opening roller 2. This edge plays no further part in the opening of the sliver. This is not the case, however, in the region of the perforations 31 and 32, where material leaves the interior space 10 of the housing 1. The perforation 31 is intended for the discharge of dirt, whereas the perforation 32 is intended for the discharge of the fibers. It may occur at both perforations 31 and 32, that fibers exit from the interior space 10 of the housing 1 through the perforation 31 or 32, but remain inside the interior space 10 with the other end. This leads to a prolonged rubbing of the fiber against the edge 310 or 320 bounding the perforation 31 or 32 in the direction of the arrow 22, until the fiber finally clears this edge 310 or 320 through the housing orifice 13 or 14 or towards the interior space 10. This rubbing effect can be further intensified by the fact that a first caught fiber retains other fibers. However, the wearing of this edge 310 or 320 also modifies its effect with regard to the separation of dirt or to the discharge of the fibers into the fiber feeding canal 15. It is, therefore, of great importance from technological considerations that the edge 310 or 320 exhibits as uniform a shape as possible, in order to ensure a uniform yarn quality.

For this reason a slide-on edge protector 4, which consists of bent sheet metal and is constructed as a spring clamp, is provided for the edges 310 and 320. Such an edge protector 4 is illustrated in detail in FIG. 3. As this figure shows, the edge protector 4 has two members 40 and 41, by means of which it is elastically slidable onto the edge 310 or 320. For this purpose the interval between the members 40 and 41 in the region adjoining the connecting curvature 42 is equal to or only slightly greater than the thickness of the sheet metal chosen for the insert 3, so that the members 40 and 41 lie (sic) as flat as possible against the surfaces adjoining the edge 310 or 320. This results, on the one hand, in a good fit of the edge protector 4 upon the edge 310 or 320; on the other hand, the edge protector 4 has little bulk. The edge protector 4 forms with its two members 40 and 41 a kind of spring clamp and retains itself on the edge 310 or 320 by the spring force acting due to the tensioning of the spring clamp. The tensioning of this spring clamp occurs by the spreading of the members 40 and 41 when the edge protector 4 is slid onto the edge 310 or 320.

The influence upon the discharge of dirt, which has been mentioned, is exerted not only in that the edge protector compensates or prevents wear of the edge 310, but also in that the shape of the edge 310 can be modified by an appropriate choice of the connecting curvature 42. For a large radius of the connecting curvature 42 a round dirt discharge edge is obtained whereas a small radius of the connecting curvature 42 produces a sharp discharge edge. Depending upon the nature of the dirt constituents contained in the fiber material, special requirements dictated by the latter can be taken into consideration by exchanging the edge protector 4.

By virtue of the good flat contact of the edge protector 4 with the sheet metal of the insert 3, further measures to secure the edge protector 4 upon the insert 3 (for example cooperating catch notches and catch beads on the mutually contacting surfaces of edge protector 4 and insert 3) are unnecessary. Since furthermore the edge protector 4 is placed upon the edge 310 or 320 to be protected in the fiber transport direction (arrow 22), the fiber transport generates an additional force which secures the edge protector 4 upon its edge 310 or 320.

The edge protector 4 can be produced extraordinarily economically. Consequently a somewhat more frequent exchange of the latter is entirely acceptable. For this reason an extremely thin sheet-metal thickness d (FIG. 3) has been chosen for the edge protector 4. For example, the insert 3 has a sheet-metal thickness e of 0.4 mm, whereas the edge protector 4 has a sheet-metal thickness d of only 0.15 mm.

The fiber material fed as a sliver to the opening device by means of the delivery device 11 is opened into individual fibers by the opening roller 2 in known manner. The guidance of the sliver in the region of the housing orifice 12 in this case is effected by the actual delivery device 11, so that the precise size of the housing orifice 12 has no particular technological importance, if it is ensured that no uncontrolled air currents can occur. Thus even wear of the edge 300 of the perforation 30 has no prejudicial effect on the yarn produced.

The fibers singled by the opening roller 2 are fed in the direction of the arrow 22 past the perforation 31—if provided—and to the perforation 32, where they leave the opening roller 2 and pass through the fiber feeding canal 15 to the open-end spinning element, not shown. Because an extraordinarily thin sheet-metal thickness d can be chosen for the edge protector 4, the constriction of the passage between the opening roller 2 and the peripheral wall 33 formed by the insert 3 is not a major factor for the fiber transport. In the region of the perforation 32, the fibers, when they reach the edge protector 4, have in any case already left the opening roller 2 so that the fibers pass the edge protector 4 only towards the fiber feeding canal 15, where the constriction of the cross-section of aperture is not important. If a dirt discharge and hence a housing orifice 13 with the associated perforation 31 in the insert 3 is provided, the fibers here are so much in or so close to the card clothing that, for them also, the constriction behind the perforation 31 involves no technological prejudice. However, the dirt constituents which are centrifuged out of the fiber/air stream by the loosening roller 2 before reaching the perforation 31, can be discharged even more reliably by this constriction than otherwise.

If, with a view to optimum dirt discharge, the perforation 31 is a long way from the perforation 30, then even lighter dirt constituents can be discharged. However, in this region the heavier fibers are also already beginning to separate from the opening roller 2. For such a relative arrangement of the perforations 30 and 31, the interior space 10 of the housing 1, according to FIG. 1, exhibits the bulge 18 referred to between the perforations 31 and 32. (sic) In order to prevent the fibers already separating from the opening roller 2 from passing through the perforation 31 into the housing orifice 13 and thus being discharged together with the dirt constituents, according to FIG. 1, the bulge 18 is constructed so that its size in the region of the edge 310 to be protected corresponds substantially to the sheet-metal thickness d of the edge protector 4. In this manner, the cross-section of the space available for the transport between opening roller 2 and peripheral wall 33 of the insert 3 is substantially of equal size in front of and behind the perforation 31.

If so desired, the size of the bulge 18 may in the same way also be chosen in the region of the edge 320 so that this size corresponds substantially to the sheet-metal thickness d of the edge protector 4.

However, the bulge 18 is not a prime condition of the present invention, because—as mentioned—the edge protector 4 has no prejudicial effects upon the fiber flow due to its small sheet-metal thickness d. It is also possible to place the edge protector 4 on the edges 310 and 320 from the outset, without waiting until they have become worn to a certain degree. Thus the spinning conditions which are influenced by the opening device are always unchanged from the date of taking into service.

The length l of the edge protector 4 is substantially equal to the length L of the edge 310 or 320 to be protected. However, as shown by the example of the edge 320 shown on FIG. 7, it is convenient if certain tolerances between these lengths L and l are observed, in order to facilitate the insertion of the edge protector 4. According to the embodiment shown in FIG. 7, therefore, the length l of the edge protector 4 is chosen slightly smaller than the length L of the edge 320.

To enable the edge protector 4 to be slid into the edge 310 and 320 without difficulty, it is necessary for the members 40 and 41 to exhibit mutually divergent surfaces at their free ends, so that when slid onto the edge 310 or 320 they slightly spread and therefore tension the members 40 and 41. If the feeding of the edge protector 4 occurs with extreme precision, a rounding or bevelling of the inner edges of the free ends of the members 40 and 41 is sufficient for this purpose. However, in this case the edge protector 4 cannot exert a strong spring force, because the two members 40 and 41 must be arranged virtually mutually parallel from the outset. Also the sliding on of the edge protector 4 is only possible if its members 40 and 41 occupy the precise mutual interval. The danger of damage to the edge protector 4 during sliding onto the edge 310 and 320 to be protected thus exists. There is also the danger of the edge protector 4 being accidentally stripped from its edge 310 or 320 by some cause.

Figure 5:
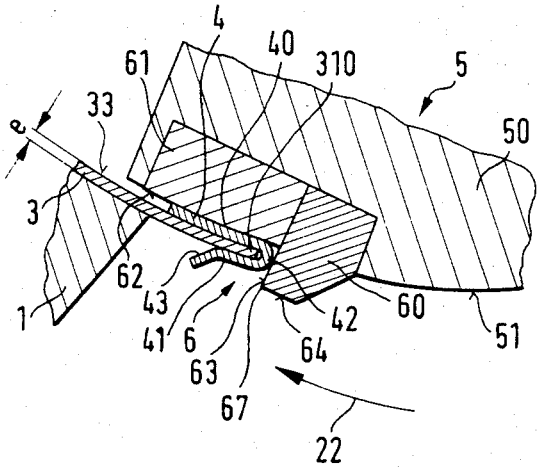
FIG. 5 shows in cross-section a detail of the apparatus shown in FIG. 4 during the insertion of the edge protector.

According to FIG. 3, the member 41 remote from the interior space 10 of the housing 1 exhibits a terminal section 43 which is spread away from the member 40 facing the interior space 10 of the housing 1 (see also FIG. 5). In this manner, the edge protector 4 is guided by the terminal section 43 reliably onto the edge 310 or 320, even if fed inaccurately to the edge 310 or 320, that is to say, if it is located somewhat too close to the interior space 10 when fed to the edge 310 or 320. Because this terminal section 43 exercises a guiding function, it is furthermore provided that the member 41 of the edge protector 4 remote from the interior space 10 of the housing 1 exhibits blunted corners 44 and 45. These blunted corners are formed by bevels on the terminal section 43, but it is also possible to blunt these corners 44 and 45 by rounding, etc. As FIG. 3 shows, it is also possible to blunt the corners 46 and 47 of the member 40 of the edge protector 4 facing the interior space 10 of the housing 1. These blunted corners 44 and 45, and possibly 46 and 47, prevent them from standing up and, therefore, rendering the insertion of the edge protector 4 difficult or impossible.

Other than in exceptional cases, the housing 1 is in the installed state in the machine during the insertion or exchange of the edge protector 4. In this case insertion of the edge protector 4 is only possible from the interior space 10 of the housing 1. This insertion can be performed most simply if the edge protector 4 is at first slid into contact with the insert 3 by a movement leading radially outwards, and then onto the edge 310 or 320 by a movement in the peripheral direction (in the direction of the arrow 22). For this purpose, according to FIG. 3, the length g of the member 40 of the edge protector 4 facing the interior space 10 of the housing 1, considered in the direction of the arrow 22, is greater than the length f of the member 41 remote from the interior space 10 of the housing 1 (see also FIG. 6). To insert the edge protector 4, the latter is introduced, the open side leading and with the shorter member 41 outwards, into the perforation 31 or 32 so that the longer member 40 first comes with its inside into contact with the peripheral wall 33 of the insert 3. While bringing about and maintaining such a flat contact between member 40 and peripheral wall 33, the edge protector 4 is moved onwards in the direction of the arrow 22, while the spread terminal section 43 rides up onto the edge 310 or 320. In order to achieve an adequate pretensioning of the edge protector 4 while sliding onto the edge 310 or 320, the members 40 and 41 of the untensioned edge protector 4 converge again to their side remote from the connecting curvature 42. The edge protector 4 is now tensioned by spreading of the members 40 and 41 by the terminal section 43 riding up onto the edge 310 or 320. The edge protector 4 is then slid further until the inside of the connecting curvature 42 comes into abutment against the edge 310 or 320.

The interior space 10 can be seen well, or not so well, depending upon the arrangement of the housing 1 in the machine. Accordingly, it may be difficult or complicated to reach the perforations 31 or 32 manually and insert the edge protector 4 correctly. The use of an insertion tool 5 is convenient in order to facilitate this operation.

Figure 4:
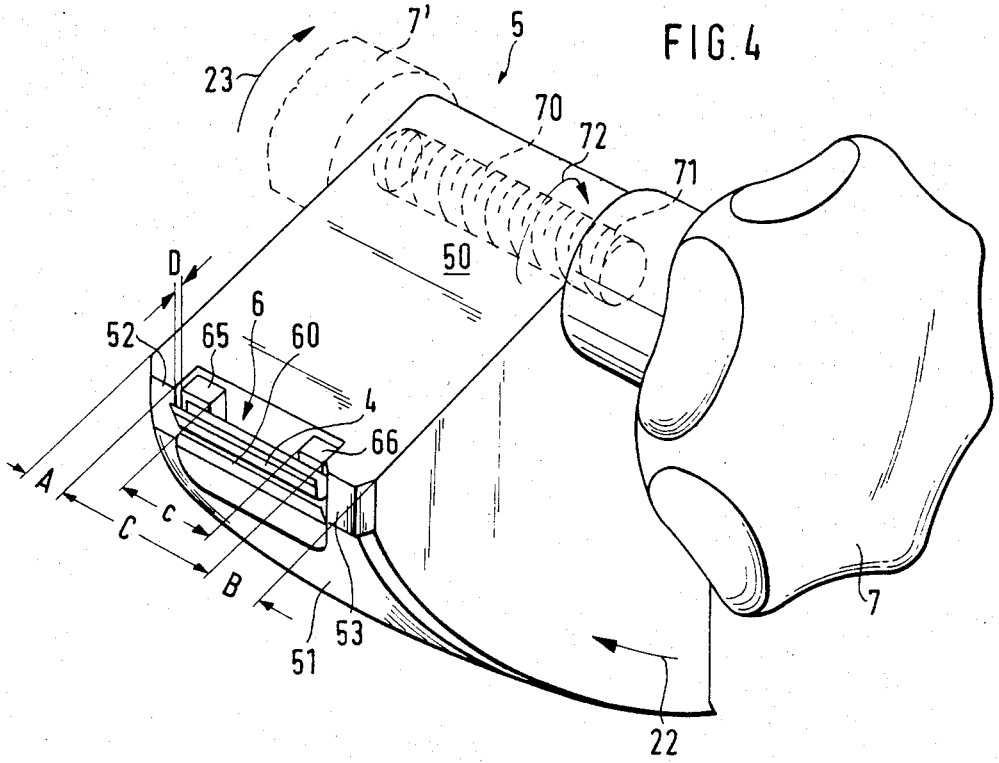
FIG. 4 shows, in a perspective view, a combined insertion and ejection tool for the edge protector, a reversible handle being provided for this combined tool.

Such an insertion tool 5 is shown in FIG. 4. It has a basic body 50 with a contact surface 51, with which it can be moved along the peripheral wall 33 of the insert 3 (compare FIG. 5). The contact surface 51 is bounded in the direction of the arrow 22—the fiber transport direction in the housing 1—by a receiving throat 6 which serves for the temporary reception of the edge protector 4. In this manner, when the insertion tool 5 is placed in the interior space 10 of the housing 1 for the purpose of its insertion work, the open side of the receiving throat 6 faces the edge 310 or 320 which is to be protected by sliding on an edge protector 4.

The receiving throat 6 is bounded by a stop 60 which overhangs the contact surface 51. This stop 60 is connected rigidly to the basic body 50 and not only serves to retain the edge protector 4 in a definite position, but also fulfills the function of sliding the edge protector 4 onto the edge 310 or 320 to be protected, as will be explained later.

The receiving throat 6 is bounded by a permanent magnet 61 on the side remote from the insert 3. The bracing surface 62 of the permanent magnet 61, which faces the insert 3 in the service position of the insertion tool 5, is oriented substantially in the same plane as the contact surface 51 of the insertion tool 5, while the stop 60 exhibits a stop surface 63 arranged substantially at right angles to the bracing surface 62 of the permanent magnet 61.

The insertion of the edge protector 4 is explained below with reference to FIGS. 4 and 5 by the example of the edge 310. First of all, before the insertion tool 5 is introduced into the interior space 10 of the housing 1, the edge protector 4 is introduced into the receiving throat 6 of the insertion tool 5 so that the longer member 40 is in snug contact with the permanent magnet 61, and the connecting curvature 42 with the stop surface 63 of the stop 60, which is the case when the edge protector 4 does not overhang either end of the receiving throat 6. The housing 1 is then opened by removing the cover 17 (FIG. 2) and the loosening roller 2 is dismantled from the housing 1 in manner know per se. The insertion tool 5 is then introduced into the interior space 10 of the housing 1 so that the open side of the edge protector 4 faces the edge 310 to be protected. The insertion tool 5 is initially in contact by the end face 64 of the stop 60 with the peripheral wall 33 of the insert 3. It is now approached to the edge 310 in the direction of the arrow 22 until, when the perforation 31 is reached, the limiting element 60 leaves the peripheral wall 33 and dips into the perforation 31. During the further movement the stop 60, by means of its stop surface 63, slides the edge protector 4 onto the edge 310.

Various measures may be adopted to ensure that the edge protector 4 passes reliably and without difficulty onto the edge 310 at the first attempt. For example, the perforation 31 and the stop 60 exhibit mutually coordinated dimensions, so that when the stop 60 penetrates into the perforation 31, the member 40 of the edge protector 4 is already positively placed on the peripheral wall 33 of the insert 3. Another measure is that the contact surface 51 is substantially adapted to the curvature of the peripheral wall 33 of the insert 3 (FIG. 4) and thus forms a perfect guide surface for the insertion tool 5, and that moreover the bracing surface 62 of the permanent magnet 61 is set back relative to the contact surface 51 by a distance D which is slightly greater than the sheet-metal thickness d of the edge protector 4 (compare with FIG. 4). Due to the correct guidance of the insertion tool 5 during its movement in the direction of the arrow 22, after the stop 60 dips into the perforation 31 and into the housing orifice 13, the edge 310 or 320 is located precisely at the level of the interstice between the members 40 and 41 of the edge protector 4.

It is not necessary for the contact surface 51 adapted to the curvature of the peripheral wall 33 of the insert 3 to be constructed as a continuous surface. It is also sufficient if at least two mutually separate partial surfaces, which conjointly form the contact surface 51, are provided on the basic body in the peripheral wall 33.

Figure 7:
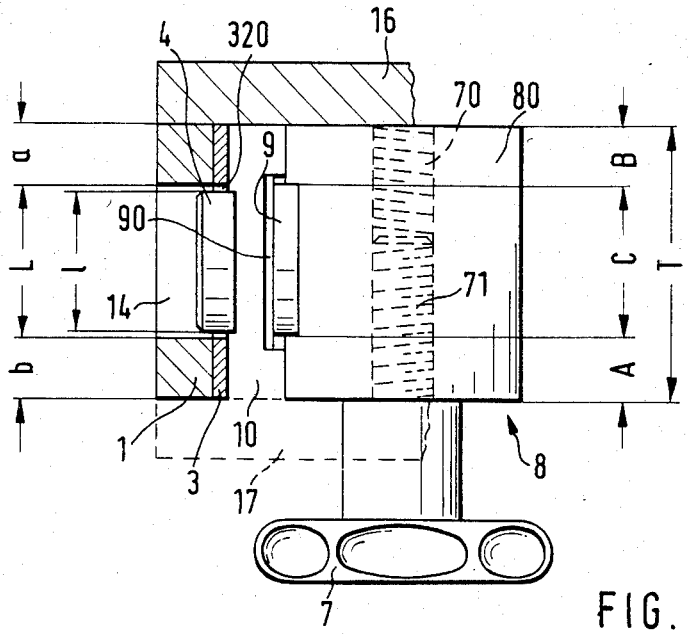
FIG. 7 shows a variant of the apparatus shown in FIG. 4 in plan view in the housing of the opening device, shown in longitudinal section.

It is also possible, as FIG. 4 shows, to give the basic body 50 a greater length T than corresponds to the length C of the receiving throat 6 (FIG. 7). The contact surface 51 is then drawn around the ends of the receiving throat 6, so that the contact surface 51 engages over the receiving throat 6 at its ends. The surface of the receiving throat 6 opposite the insert 3, which surface is formed by the bracing surface 62 of the permanent magnet 61, is lowered relative to the contact surface 51 by the distance D, which corresponds substantially to, or is slightly greater than, the material thickness d of the edge protector 4 (FIG. 4). The precise insertion of the edge protector 4 into the receiving throat 6 is facilitated by this measure.

In order to facilitate the insertion of the edge protector 4 into the receiving throat 6, according to FIG. 4, instead of a single permanent magnet 61 extending over the total length C of the receiving throat, a permanent magnet is provided subdivided into two partial magnets 65 and 66, which are arranged at the mutual interval c at the two ends of the receiving throat 6. The value of this interval c is chosen so that an operator can grip slightly between the two partial magnets 65 and 66 with his finger.

As FIGS. 2 and 7 show, the perforations 31 and 32 do not generally extend over the total axial extent of the interior space 10 of the housing 1, but only over a certain part thereof, so that the perforations 31 and 32 are enclosed all around by the sheet metal of the insert 3. In order to ensure, without having to look into the interior space 10 of the housing 1, that the edge protector 4 is fed to the edge 310 or 320 precisely and not somewhat staggered in length, the insertion tool 5 has between its receiving throat 6 and its end facing the fixed end wall 16 of the housing a bracing length A which corresponds substantially to the interval a between the end wall 16 and the perforation 31 or 32. In this manner it is achieved that the edge protector 4 received by the receiving throat 6 is fed reliably to the edges 310 or 320 when the basic body 50 is braced against the end wall 16 of the housing 1 during its movement along the arrow 22.

In the case of worn edges 310 or 320, it may occur that they also exhibit an irregular shape in the radial direction—relative to the interior space 10 of the housing 1. Although these dimensional deviations are relatively small, an imprecise introduction of the insertion tool 5 could, by a sharp edge of the insertion tool 5 striking this irregular edge 310 or 320, lead to a further deformation, which then no longer admits sliding on an edge protector 4. In order to totally exclude this—inherently slight-danger, according to FIG. 4, the contact surface 51 which engages over the receiving throat 6 at its ends, merges into ramp surfaces 52 and 53 at its leading end relative to the arrow 22. The leading end of the contact surface 51 is to be understood here to mean its end which is near the receiving throat 6 in the peripheral direction of the insert 3. According to FIG. 4 the ramp surfaces 52 and 53 are constructed as bevels, but it is also possible to choose roundings with an appropriately chosen constant or variable radius of curvature as ramp surfaces instead of the inclined plane surfaces. Such curved ramp surfaces 82 and 83 are illustrated in the case of another preferred embodiment with cylindrical basic body 80 in FIG. 8.

It is of course possible to grip the basic body 50 of the insertion tool 5 directly when inserting the edge protector 4. However, the insertion tool 5 is handier when it carries a handle 7 on its side remote from the end wall 16 of the housing 1.

If the edge protector 4 has become worn after a certain service life, so that it is required to be exchanged for a new edge protector 4, then the ejection of the edge protector 4 can, without difficulty, be performed manually without further auxiliary means. It is only necessary for this purpose to stroke with the fingernail along the peripheral wall 33 of the insert 3 in the opposite direction of the arrow 22—that is to say, in the direction to the arrow 23 (FIG. 6) and thereby to slide the edge protector 4 off its edge 310 or 320. If no perforation 31 is provided, then the edge protector 4, when stripped from the edge 310 or 320, falls into the lower part of the interior space 10 of the housing 1 and can be removed from there. If a perforation 31 is provided, then the edge protector 4, when stripped from the edge 320, falls through the perforation 31 and is in due course transported away from there with the dirt, either pneumatically or by means of a conveyor belt. The same is the case if the edge protector 4 is stripped from the edge 310 itself.

In order to guard against injuries, an ejection tool may be used for stripping off the edge protector 4. Such an ejection tool, in which those parts essential to the function correspond substantially to those of the insertion tool 5, but are provided in a reversed sides arrangement thereto, is described below. The relevant parts are illustrated in FIG. 6; a separate description thereof is therefore superfluous, so that it is sufficient to discuss them as to their function.

Figure 6:
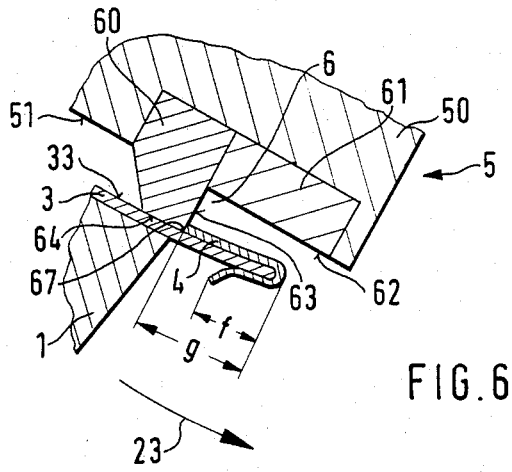
FIG. 6 shows in cross-section the detail shown in FIG. 5 during the ejection of the edge protector.

In order to eject an edge protector 4, the ejection tool (the basic body 50 of which is illustrated in FIG. 6) is introduced into the interior space 10 and moved along the peripheral wall 33 of the insert 3 in the direction of the arrow 23. The end face 64, which overhangs the contact face 51 of the ejection tool, is then in contact withwith the peripheral wall 33. The end face 64 forms, conjointly with the stop surface 63, a sharp stripping edge 67 which scrapes along the peripheral wall 33 during movement. Stripping edge 67 and the stop surface 63 then comes into contact with member 40 of the edge protector 4 and strip the latter from the edge 310 or 320, so that the edge protector 4 falls downwards.

This falling down of the edge protector 4 involves the danger that it may fall out of the open side of the housing 1 and into the machine. On the other hand, it is frequently undesirable for parts, particularly metal parts of the size of the edge protector 4, to be present among the dirt discharged through the perforation 31, since they may pass with the dirt to a cleaning filter and damage the latter. In order to prevent this, it is provided, according to FIG. 6, that the ejection tool carries a permanent magnet 61 in front of the sharp stripping edge 67 in the stripping direction—which is designated by the arrow 23 in FIG. 6. Now when the stripping edge 67 conjointly with the stop surface 63 strips the edge protector 4 from the edge 310 or 320, the edge protector 4, when stripped from the edge 310 or 320, is attracted by the permanent magnet 61 and remains adhering thereto.

Because the insertion tool 5 and the ejection tool act in different directions, it is possible to arrange the associated components according to FIGS. 5 and 6 on the two opposite sides of the contact surface 51 of a common basic body 50 and thus to produce a combined insertion and ejection tool, in which case the permanent magnet 61 or the two partial magnets 65 and 66 for the ejection direction may possibly be omitted.

Since the tools for inserting an edge protector 4 into the housing 1, and also for stripping the edge protector 4 from the edge 310 or 320 of the insert 3 are substantially identical, it is unnecessary to provide these tools doubly on the basic body 50. It is sufficient to construct the transition from the stop surface 63 to the end face 64, which may also be of rounded construction in the case of the insertion tool 5, with a sharp edge to form a stripping edge 67 and to construct such a combined insertion and ejection tool for introduction into the insert 3 rotated through 180°. The overall length T of the basic body 50 is a decisive factor in this context, because this overall length T must not exceed the depth of the interior space 10 of the housing 1. On the contrary, according to FIG. 7, it is provided that the overall length T of the basic body 50 is precisely equal to the depth of the interior space 10. In this case the stop 60—as already mentioned above—is equipped with a sharp stripping edge 67.

When such a combined insertion and ejection tool is introduced into the interior space 10 of the housing 1 so that the receiving throat 6 leads in the direction of the arrow 22, the edge protector 4 can be placed onto the edge 310 or 320 in the manner previously described with this combined insertion and ejection tool. However, when the insertion and ejection tool is introduced into the insert 3 so that the receiving throat 6 leads in the direction of the arrow 23, than an edge protector 4 can be stripped from the edge 310 or 320 with this combined tool.

As already explained, it is advantageous if the insertion tool 5 particularly can be braced against the end wall 16 of the housing 1 during the movement in the direction of the arrow 22. The same is also obviously advantageous in the case of an ejection tool during its movement in the direction of the arrow 23.

In order to achieve this advantage also in the case of a combined insertion and ejection tool, the overall length T of this tool—as already mentioned, is precisely equal to the depth of the interior space 10 of the housing 1. If, as is customary, the perforations 30, 31, and 32 do (sic) not extend from one end wall 16 to the other end wall formed by the removable cover 17, but are arranged centrally between these end walls and at an interval therefrom, then the combined insertion and ejection tool also exhibits a bracing length A or B respectively corresponding to the interval a or b between perforation 31 or 32 and end wall 16 or cover 17 on each side of the receiving throat 6. Because the intervals a and b and, hence, also the bracing length A and B are respectively equal in pairs, the edge protector 4 can be correctly fed to the edge 310 or 320 to be protected by this combined insertion and ejection tool, and the edge protector 4 can also be reliably stripped from its edge 310 or 320 by this combined injection and ejection tool.

To permit such a combined insertion and ejection tool to be likewise operated, according to FIG. 4, the handle 7 is reversible from the one end of the basic body 50 to the other end. For this purpose, according to FIG. 7, a continuous tapped bore 70 is provided in the basic body 50, into which the handle 7 can be screwed by a lug constructed as a screwbolt 71.

During the insertion movement, an increased resistance is opposed to the insertion and ejection tool from the moment when the edge protector 4 has reached the edge 310 or 320 to be protected. In order that the handle 7 does not then become loose on the basic body 50, the screwthreaded connection between the handle 7 and the combined insertion and ejection tool, formed by the tapped bore 70 and the screwthreaded bolt 71, is constructed so that the direction 72 of the screwthread pitch coincided with the insertion direction (arrow 22) of the edge protector 4. On the one hand, the connection between basic body 50 and handle 7 during each insertion operation is improved by this means. However, what is much more important is the fact that a reliable and correct sliding of the edge protector 4 onto the edge to be protected is also thus achieved.

In order to eject the edge protector, the handle 7 is transferred from the position shown by a solid line in FIG. 7 into the position 7' indicated by a dash line. As a comparison of the arrow 23 designating the stripping direction with the direction 72 of the screwthread pitch indicated shows, any firm resistance opposing the movement in the direction of the arrow 23 would result in a loosening of the handle 7. However, the edge protector 4 puts up such weak resistance to the stripping movement that the handle 7 is not loosened, but remains firmly connected to the basic body 50.

The above description shows that the insertion tool, the ejection tool and also the combined insertion and ejection tool are capable of variation in numerous manners. Thus it is not absolutely necessary for the receiving throat 6 to be formed by a permanent magnet 61 or by two partial magnets 65 and 66 and a stop surface 63 of a stop 60 arranged at an angle thereto. On the contrary, other constructions are also possible.

Figure 8:
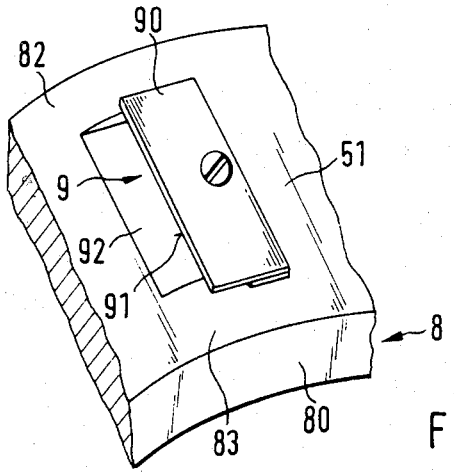
FIG. 8 shows a detail of the apparatus shown in FIG. 7 in a perspective view.

FIGS. 7 and 8 show such a variant of a combined insertion and ejection tool 8. This tool 8 has a cylindrical basic body 80 with a tapped bore 70, into which a handle 7 with a screwthreaded bolt 71 can be screwed selectively from one or the other end. The receiving throat 9 in this preferred embodiment is formed by a substantially tangential bracing surface 92 in the basic body 80, which terminates at a substantially radial stop surface 81. On its side facing the insert 3, that is to say on its radially external side, the receiving throat 9 is bounded by a resilient stop 90, which is for example screwed onto the basic body 80 and overhangs the cylindrical stop surface 51 of the basic body 50.

The bracing surface 92, which conjointly with the resilient stop 90 forms the receiving throat 9, again exhibits a length C which corresponds substantially to the length l of the edge protector 4. In this manner, a precise feeding of the edge protector 4 to the edge 310 or 320 to be protected is again achieved in this case by the length C in conjunction with the bracing length A.

Again in this preferred embodiment the resilient stop 90 exhibits a sharp stripping edge 91, so that when this stripping edge 91 strikes the edge protector 4 the latter is reliably removed from the edge 310 or 320. The edge protector 4 then, after leaving the edge 310 or 320, falls downwards as described in conjunction with the manual stripping.

In both the preferred embodiments explained, the handle 7 is illustrated as a type of star handle which is connected to the basic body 50 or 80 by a screwthreaded joint. Obviously, the handle 7 may exhibit any desired other shape and also be connected to the basic body 50 or 80 in a different manner. For example, a catch joint, which is simultaneously constructed as a rotation lock (for example, square) is also a possibility.

Further variations of the apparatus described by mutual interchange of features or by substitution by equivalents and their combinations fall within the scope of the present invention.

What is claimed is:

1. An open-end spinning apparatus having a housing, a fixed end wall for said housing supporting an opening roller, and openable cover provided on said housing, a thin-walled insert carried in an interior space of said housing encompassing said opening roller, openings provided in said insert which correspond to housing orifices which connect the interior space of said housing to other parts of the spinning apparatus, an edge of said insert downstream relative to the fiber flow which bounds the opening for discharging material out of the interior space partly masking said housing opening, the improvement comprising:

an edge protector slidable onto and engaging said edge of said insert.

2. An apparatus as claimed in claim 1, wherein the thickness (d) of said edge protector (4) is smaller than the thickness (e) of the thin-walled insert (3).

3. An apparatus as claimed in claim 1 wherein a portion (41) of said edge protector (4) remote from the interior space (10) of the housing (1) exhibits a terminal section (43) which stands away from the member (40) facing the interior space (10).

4. An apparatus as claimed in claim 1, wherein a portion (40) of said edge protector (4) facing the interior space (10) of the housing (1), considered in the peripheral direction of the interior space (10), exhibits a greater length (g) than the portion (41) remote from the interior space (10).

5. An apparatus as claimed in claim 1 wherein said opening roller having card clothing points thereon, the interval between the peripheral wall (33) and the card clothing points (20) of said loosening roller (2) is determinable by the thickness of the member (41) of the edge protector (4) located in the interior space (10) of the housing (1).

* * * * *